US006502585B1

(12) United States Patent
Mazzei et al.

(10) Patent No.: US 6,502,585 B1
(45) Date of Patent: Jan. 7, 2003

(54) HAIRSTYLING DEVICE HAVING COUPLING AND INTERCHANGEABLE HEADS

(76) Inventors: Gino Mazzei, 21 Robin Hood Road, Etobicoke, Ontario (CA), M9A 2W6; Antonio Di Santo, 48 A St Anderws, Etobicoke, Ontario (CA), M9R 1W1

( * ) Notice: Subject to any disclaimer, the term of this patent is extended or adjusted under 35 U.S.C. 154(b) by 183 days.

(21) Appl. No.: 09/697,977

(22) Filed: Oct. 26, 2000

(51) Int. Cl.[7] ..... A45D 6/02

(52) U.S. Cl. ..... 132/237; 132/313; 15/176.1; 15/176.6; 403/322.3; 403/325

(58) Field of Search ..... 132/223, 226, 132/237, 265, 266, 267, 262, 271, 286, 312, 313, 314, 315, 120, 122, 150; 15/145, 176.1, 176.6; 206/443, 362; D4/138, 127, 128, 130, 132, 133, 134; 403/321, 322.1, 322.3, 324, 325, DIG. 4; 16/422, 425, 426

(56) References Cited

U.S. PATENT DOCUMENTS 3,967,630 A * 7/1976 Zuhlsdorff et al. ..... 132/262
5,887,600 A * 3/1999 Wilk ..... 132/262
5,954,064 A * 9/1999 Motherhead ..... 132/262
5,975,091 A * 11/1999 Balanchi ..... 132/237
5,992,423 A * 11/1999 Tevolini ..... 132/200
6,029,307 A * 2/2000 Baudoin ..... 15/145
6,230,716 B1 * 5/2001 Minoletti ..... 132/226

* cited by examiner

*Primary Examiner*—Todd E. Manahan
*Assistant Examiner*—David Comstock

(57) ABSTRACT

A hairstyling device for providing a user with a selection of interchangeable heads. The hairstyling device comprises a handle member. The handle member includes a first end and a second end. The first end of the handle member includes a cavity. The handle member includes a pair of elongated slots. There is a nub that includes a top wall, a peripheral wall integrally coupled to and extending away from the top wall. A free edge of the peripheral wall is integrally coupled to the first end of the handle member. There are a plurality of heads that include a first end and a second end with a peripheral wall extending therebetween. Each of the second ends of the heads includes a bore extending therein. Each of the bores includes a base wall and an inner side wall. The inner side wall includes a pair of wells therein. Each of the bores includes a size and shape designed for removably receiving the nub. There is a coupling means for removably connecting one of the heads to the handle member. The coupling means includes a size and shape designed for removably positioning in the pair of wells of one of the heads.

10 Claims, 2 Drawing Sheets

HAIRSTYLING DEVICE HAVING COUPLING AND INTERCHANGEABLE HEADS

BACKGROUND OF THE INVENTION

1. Field of the Invention

The present invention relates to brushes and more particularly pertains to a new hairstyling device for providing a user with a selection of interchangeable heads.

2. Description of the Prior Art

The use of brushes is known in the prior art. More specifically, brushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,992,423; 5,479,951; 4,605,023; 5,865,188; 5,273,058; and U.S. Pat. No. Des. 324,454.

While these devices fulfill their respective, particular objectives and requirements, the aforementioned patents do not disclose a new hairstyling device. The inventive device includes a hairstyling device comprising a handle member. The handle member includes a first end and a second end. The first end of the handle member includes a cavity. The handle member includes a pair of elongated slots. There is a nub that includes a top wall, a peripheral wall integrally coupled to and extending away from the top wall. A free edge of the peripheral wall is integrally coupled to the first end of the handle member. There are a plurality of heads that include a first end and a second end with a peripheral wall extending therebetween. Each of the second ends of the heads includes a bore extending therein. Each of the heads includes a base wall and an inner side wall. The inner side wall includes a pair of wells therein. Each of the bores includes a size and shape designed for removably receiving the nub. There is a coupling means for removably connecting one of the heads to the handle member. The coupling means includes a size and shape designed for removably positioning in the pair of wells of one of the heads.

In these respects, the hairstyling device according to the present invention substantially departs from the conventional concepts and designs of the prior art, and in so doing provides an apparatus primarily developed for the purpose of providing a user with a selection of interchangeable heads.

SUMMARY OF THE INVENTION

In view of the foregoing disadvantages inherent in the known types of brushes now present in the prior art, the present invention provides a new hairstyling device construction wherein the same can be utilized for providing a user with a selection of interchangeable heads.

The general purpose of the present invention, which will be described subsequently in greater detail, is to provide a new hairstyling device apparatus and method which has many of the advantages of the brushes mentioned heretofore and many novel features that result in a new hairstyling device which is not anticipated, rendered obvious, suggested, or even implied by any of the prior art brushes, either alone or in any combination thereof.

To attain this, the present invention generally comprises a hairstyling device comprising a handle member. The handle member includes a first end and a second end. The first end of the handle member includes a cavity. The handle member includes a pair of elongated slots. There is a nub that includes a top wall, a peripheral wall integrally coupled to and extending away from the top wall. A free edge of the peripheral wall is integrally coupled to the first end of the handle member. There are a plurality of heads that include a first end and a second end with a peripheral wall extending therebetween. Each of the second ends of the heads includes a bore extending therein. Each of the heads includes a base wall and an inner side wall. The inner side wall includes a pair of wells therein. Each of the bores includes a size and shape designed for removably receiving the nub. There is a coupling means for removably connecting one of the heads to the handle member. The coupling means includes a size and shape designed for removably positioning in the pair of wells of one of the heads.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hairstyling device apparatus and method which has many of the advantages of the brushes mentioned heretofore and many novel features that result in a new hairstyling device which is not anticipated, rendered obvious, suggested, or even implied by any of the prior art brushes, either alone or in any combination thereof.

It is another object of the present invention to provide a new hairstyling device which may be easily and efficiently manufactured and marketed.

It is a further object of the present invention to provide a new hairstyling device which is of a durable and reliable construction.

An even further object of the present invention is to provide a new hairstyling device which is susceptible of a low cost of manufacture with regard to both materials and labor, and which accordingly is then susceptible of low prices of sale to the consuming public, thereby making such hairstyling device economically available to the buying public.

Still yet another object of the present invention is to provide a new hairstyling device which provides in the apparatuses and methods of the prior art some of the advantages thereof, while simultaneously overcoming some of the disadvantages normally associated therewith.

Still another object of the present invention is to provide a new hairstyling device for providing a user with a selection of interchangeable heads.

Yet another object of the present invention is to provide a new hairstyling device which includes handle member. The handle member includes a first end and a second end. The first end of the handle member includes a cavity. The handle member includes a pair of elongated slots. There is a nub that includes a top wall, a peripheral wall integrally coupled to and extending away from the top wall. A free edge of the peripheral wall is integrally coupled to the first end of the handle member. There are a plurality of heads that include a first end and a second end with a peripheral wall extending therebetween. Each of the second ends of the heads includes a bore extending therein. Each of the heads includes a base wall and an inner side wall. The inner side wall includes a pair of wells therein. Each of the bores includes a size and shape designed for removably receiving the nub. There is a coupling means for removably connecting one of the heads to the handle member. The coupling means includes a size and shape designed for removably positioning in the pair of wells of one of the heads.

Still yet another object of the present invention is to provide a new hairstyling device that allows its heads to be releasable from its handle so that the head may stay curled in a person's hair. This would allow a person to keep the brush in the hair while blowing drying thereby achieving a better curl.

Even still another object of the present invention is to provide a new hairstyling device that may be used with a variety of hair types to create full or straight styles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
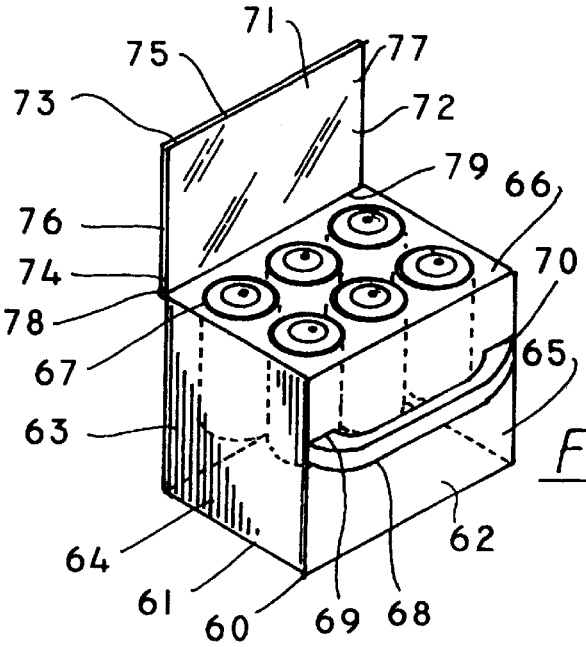
FIG. 1 is a schematic perspective view of a new hairstyling device according to the present invention showing the housing.
Figure 5:
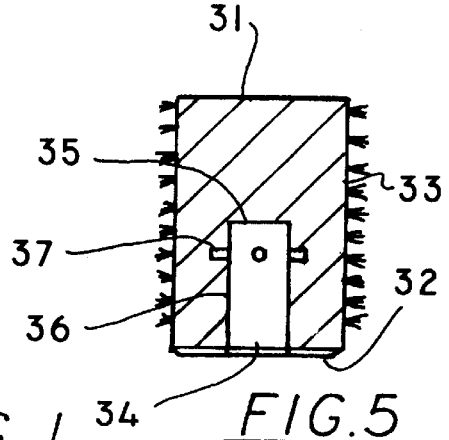
FIG. 5 is a schematic cross-sectional view of the present invention taken along line 5—5 showing the bore and a pair of wells of a head.
Figure 3:
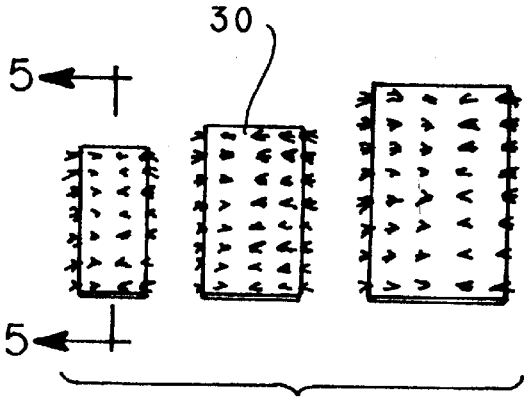
FIG. 3 is a schematic side view of the present invention showing the variety of sizes of the heads.
Figure 4:
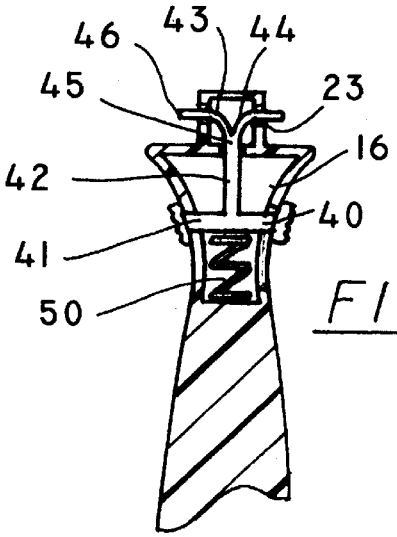
FIG. 4 is a schematic cross-sectional view of the present invention showing the coupling means positioned in the handle member.
Figure 2:
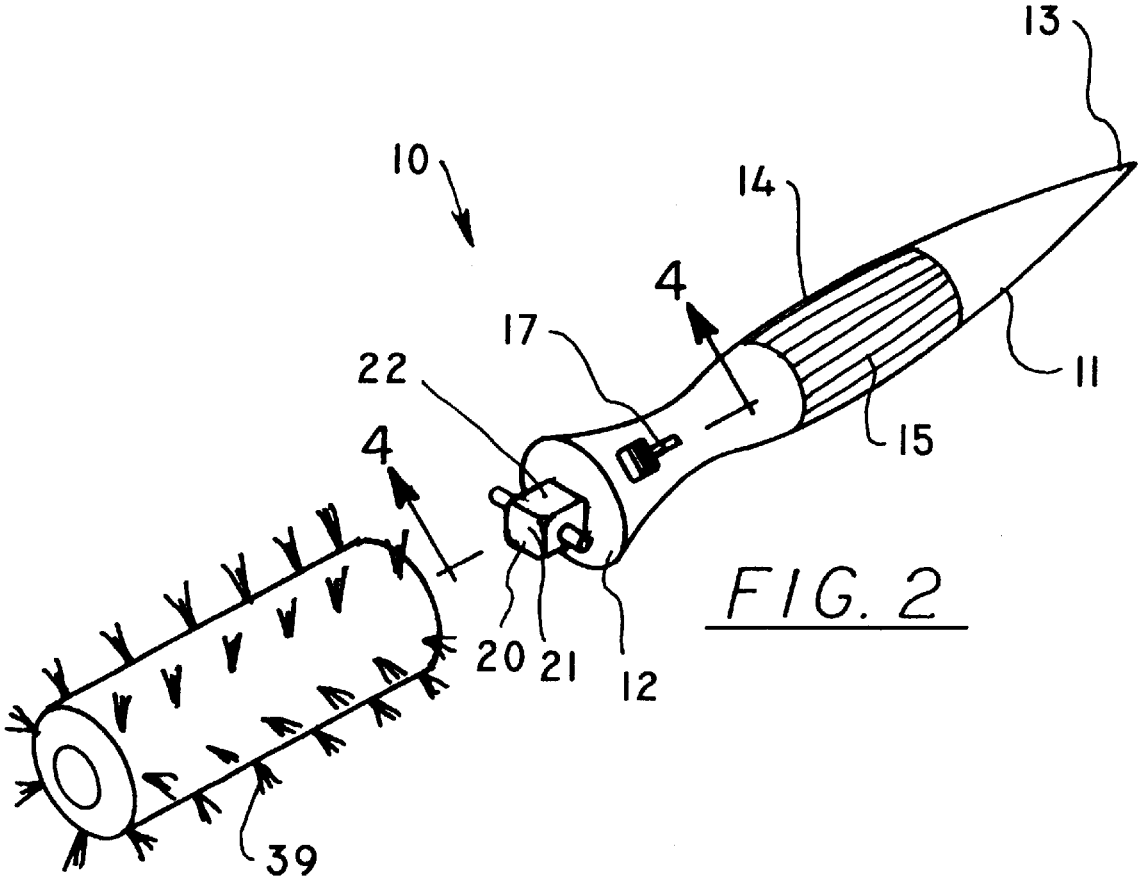
FIG. 2 is a schematic perspective view of the present invention showing the handle member and one of the heads.

With reference now to the drawings, and in particular to FIGS. 1 through 5 thereof, a new hairstyling device embodying the principles and concepts of the present invention and generally designated by the reference numeral 10 will be described.

As best illustrated in FIGS. 1 through 5, the hairstyling device 10 generally comprises a hairstyling device comprising: a handle member 11. The handle member 11 is elongated and includes a first end 12 and a second end 13. The handle member 11 tapers from a middle portion 14 of the handle member 11 to the second end 13. The handle member 11 may be made out of any generally rigid material such as plastic or metal The handle member 11 includes a gripping portion 15 integrally coupled to the middle portion 14 of the handle member 11. The gripping portion 15 is positioned generally between the first 12 and second ends 13. The gripping portion 15 provides a user with better handling of the invention during use. The gripping portion 15 may be made out of a resiliently flexible material such as rubber or may be composed of a generally rigid material such as plastic or metal.

The handle member 11 includes a cavity 16 positioned generally adjacent to the first end 12 of the handle member 11. The handle member 11 includes a pair of elongated slots 17 extending into the cavity 16. Each of the elongated slots 17 is positioned generally adjacent to the first end 12 and positioned generally opposite of each other.

The handle member 11 includes a nub 20. The nub 20 includes a top wall 21. There is a peripheral wall 22 integrally coupled to the top wall 21 and extending downwardly away from the top wall 21. A free edge of the peripheral wall 22 is integrally coupled to the first end 12 of the handle member 11. The peripheral wall 22 includes a pair of holes 23 positioned generally coaxial.

There are a plurality of heads 30 that may be attached to the handle member 11. Each of the heads 30 is elongated and includes a first end 31 and a second end 32 with a peripheral wall 33 extending between the first 31 and second ends 32. Each of the second ends 32 of the heads 30 include a bore 34 extending into the head 30. Each of the bores 34 includes a base wall 35 and an inner side wall 36.

The inner side wall 36 includes plurality of wells 37 positioned generally adjacent to the base wall 34 and orientated generally perpendicular to a longitudinal axis of the bore 30. Each of the wells 37 is positioned generally opposite of each other. The bore 34 includes a size and shape designed for removably receiving the nub 20.

Each of the peripheral walls 33 of the heads 30 include a plurality of bristles 39 integrally attached thereto and extending outwardly from the surface of the peripheral wall 33. Each of the bristles 39 are orientated generally perpendicular to the peripheral wall 33. Each of the bristles 39 comprises a resiliently flexible material such as a flexible plastic.

There is a coupling means 40 for removably connecting one of the heads 30 to the handle member 11. The coupling means 40 includes a rod 41 positioned between and movably positioned in the pair of elongated slots 17 of the handle member 11. The rod 41 may be made of a generally rigid material such as plastic or metal.

An upstanding member 42 is integrally coupled to and extends upwardly from a middle portion of the rod 41. The upstanding member 42 movably extends through the first end 12 of the handle member 11 and into the nub 20. There are a pair of elongated members 43, that include a first end 44 integrally coupled to a free end 45 of the upstanding member 42. Each of the elongated members 43 include a second end 46 that is movably extendable through one of the holes 23 in the nub 20.

There is a biasing means 50 for maintaining the coupling member 40 in an extended position. The biasing means 50 is positioned in the cavity 16 between the rod 41 and the second end 13 of the handle member 11. The biasing means 50 exerts an upward force upon the rod 41 which forces the upstanding member 42 upward pushing the elongated members 43 into the wells 37 of one of the heads 30, thus, releasably coupling one of the heads 30 to the handle member 11. The biasing means 50 generally comprises a spring.

There is also a housing 60 that provides storage for the plurality of heads 30. The housing 60 includes a bottom wall 61, a front wall 62, a back wall 63, a first side wall 64, a second side wall 65 and a top wall 66. The top wall 66 includes a plurality of wells 67 extending into the housing. Each of the wells 67 includes a different length and circumference.

The housing 60 includes a carrying member 68 to carry the housing 60. The carrying member 68 is elongated and includes a first end 69 and a second end 70. Each of the ends 69 and 70 is integrally coupled to and extending away from the front wall 62 of the housing 60. The first end 69 is positioned generally adjacent to the first side wall 64. The second end 70 is positioned generally adjacent to the second side wall 65. The carrying member 68 is positioned generally between the top wall 66 and the bottom wall 61.

There is a cover portion 71 to prevent the heads 30 from getting dirty or fall out of the housing 60. The cover portion 71 comprises a panel that includes a first side 72, a second side 73, a first edge 74, a second edge 75, a third edge 76 and a fourth edge 77.

There is a hinging means 78 for hingedly coupling the first edge 74 of the panel to a top edge 79 of the back wall 63. The panel is selectively positionable between an open position and a closed position.

In an embodiment each of the heads 30 includes a size and shape designed to be positioned in one of the wells 67 of the housing 60.

In use, the rod 42 if the coupling means 40 is pulled downwardly against the biasing means 50. The elongated members 43 are then pulled into the nub 20. This allows one of the pluralities of heads to be positioned onto the nub 20. When the user releases the rod 42, the elongated members are seated in the wells 37 of one of the heads 30, thus, removably coupling one of said heads 30 to said handle member 11. To change heads 30, a user merely pulls downwardly on the rod 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hairstyling device comprising:

a handle member, said handle member having a first end and a second end, said first end of said handle member having a cavity therein, said handle member having a pair of elongated slots therein;

a nub, said nub having a top wall, a peripheral wall integrally coupled thereto and extending away from said top wall, a free edge of said peripheral wall being integrally coupled to said first end of said handle member;

a plurality of heads, each of said heads being elongated having a first end and a second end with a peripheral wall extending therebetween, each of said second ends of said heads having a bore extending therein, each of said heads having a base wall and an inner side wall, said inner side wall having a pair of wells therein, each of said bores having a size and shape adapted for removably receiving said nub;

a coupling means for removably connecting one of said heads to said handle member, said coupling means having a size and shape adapted for removably positioning in said pair of wells of one of said heads; and said coupling means including a rod, said rod being positioned between and movably positioned in said pair of elongated slots of said handle member, an upstanding member being integrally coupled to a middle portion of said rod and extending upwardly therefrom, said upstanding member movably extending through said first end of said housing and extending into said nub, a pair of elongated member, each of said elongated members having a first end integrally coupled to a free end of said upstanding member, each of said elongated members having a second end being movably extended through a pair of holes in said nub.

2. The hairstyling device of claim 1, wherein said handle member further comprises:

said handle member tapering from a middle portion of said handle member to said second end.

3. The hairstyling device of claim 2, further comprising:

a gripping portion, said gripping portion being integrally coupled to said middle portion of said handle member, said handle member being positioned generally between said first and second ends.

4. The hairstyling device of claim 1, wherein said handle member further comprises:

said second end of said handle member having a point.

5. The hairstyling device of claim 1, wherein said plurality of heads further comprises:

each of said peripheral walls of said heads having a plurality of bristles integrally attached thereto and extending outwardly therefrom, each of said bristles being orientated generally perpendicular to said peripheral wall.

6. The hairstyling device of claim 1, further comprising:

a biasing means for maintaining said coupling member in an extended position, said biasing means being positioned in said cavity between said coupling means and second end of said handle member.

7. The hairstyling device of claim 1, further comprising:

a housing, said housing having a bottom wall, a front wall, a back wall, a first side wall, a second side wall and a top wall, said top wall having a plurality of wells extending therein, each of said wells having a different size.

8. The hairstyling device of claim 7, wherein said housing further comprises:

said housing having a carrying member being elongated having a first end and a second end, each of said ends being integrally coupled to and extending away from said front wall of said housing, said first end being positioned generally adjacent to said first side wall, said second end being positioned generally adjacent to said second side wall, said carrying member being positioned generally between said top wall and said bottom wall.

9. The hairstyling device of claim 7, wherein said housing further comprises:

said housing having a cover portion, said cover portion comprising a panel having a first side and a second side, a first edge, a second edge, a third edge and a fourth edge, a hinging means for hingedly coupling said first edge of said panel to a top edge of said back wall, said panel being selectively positionable between an open position and a closed position.

10. A hairstyling device comprising:

a handle member, said handle member being elongated having a first end and a second end, said handle member tapering from a middle portion of said handle to said second end, said handle member having a gripping portion integrally coupled to said middle portion of said handle member, said gripping portion being positioned generally between said first and second ends, said handle member having a cavity therein, said cavity being positioned generally adjacent to said first end, said handle member having a pair of elongated slots extending into said cavity, each of said elongated slots being positioned generally adjacent to said first end and positioned generally opposite of each other;

a nub, said nub having a top wall, a peripheral wall integrally coupled thereto and extending away from said top wall, a free edge of said peripheral wall being integrally coupled to said first end of said handle member, said peripheral wall having a pair of holes therein, said holes being generally coaxial;

a plurality of heads, each of said heads being elongated having a first end and a second end with a peripheral wall extending therebetween, each of said second ends of said heads having a bore extending therein, each of said bores having a base wall and an inner side wall, said inner side wall having plurality of wells extending therein, each of said wells being positioned generally adjacent to said base wall and orientated generally perpendicular to a longitudinal axis of said bore, each of said wells being positioned generally opposite of each other, said bore having a size and shape adapted for removably receiving said nub, each of said peripheral wall of said heads having a plurality of bristles integrally attached thereto and extending outwardly therefrom, each of said bristles being orientated generally perpendicular to said peripheral wall, each of said bristles comprising a resiliently flexible material;

a coupling means for removably connecting one of said heads to said handle, said coupling means including a rod, said rod being positioned between and movably positioned in said pair of elongated slots of said handle member, an upstanding member being integrally coupled to a middle portion of said rod and extending upwardly therefrom, said upstanding member movably extending through said first end of said housing and extending into said nub, a pair of elongated member, each of said elongated members having a first end integrally coupled to a free end of said upstanding member, each of said elongated members having a second end being movably extended through one of said holes in said nub, each of said;

a biasing means for maintaining said coupling member in an extended position, said biasing means being positioned in said cavity between said rod and said second end of said handle member;

a housing, said housing having a bottom wall, a front wall, a back wall, a first side wall, a second side wall and a top wall, said top wall having a plurality of wells extending therein, each of said wells having a different size, a carrying member being elongated having a first end and a second end, each of said ends being integrally coupled to and extending away from said front wall of said housing, said first end being positioned generally adjacent to said first side wall, said second end being positioned generally adjacent to said second side wall, said carrying member being positioned generally between said top wall and said bottom wall;

a cover portion, said cover portion comprising a panel having a first side and a second side, a first edge, a second edge, a third edge and a fourth edge;

a hinging means for hingedly coupling said first edge of said panel to a top edge of said back wall, said panel being selectively positionable between an open position and a closed position; and wherein each of said heads having a size and shape adapted to being positioned in one of said wells of said housing.

* * * * *